US006392179B1

(12) United States Patent
Schwarzbich

(10) Patent No.: US 6,392,179 B1
(45) Date of Patent: May 21, 2002

(54) PUSHBUTTON UNIT

(76) Inventor: Jörg Schwarzbich, Wertherstr. 15, D-33615, Bielefeld (DE)

( * ) Notice: Subject to any disclaimer, the term of this patent is extended or adjusted under 35 U.S.C. 154(b) by 0 days.

(21) Appl. No.: 09/486,061

(22) PCT Filed: Aug. 11, 1998

(86) PCT No.: PCT/EP98/05073

§ 371 Date: Feb. 22, 2000

§ 102(e) Date: Feb. 22, 2000

(87) PCT Pub. No.: WO99/10905

PCT Pub. Date: Mar. 4, 1999

(30) Foreign Application Priority Data

Aug. 27, 1997 (DE) ..... 297 15 337 U

(51) Int. Cl.[7] ..... H01H 13/14
(52) U.S. Cl. ..... 200/520; 200/341
(58) Field of Search ..... 200/534, 293, 200/329, 330, 341, 343, 406, 317

(56) References Cited

U.S. PATENT DOCUMENTS 3,952,175 A 4/1976 Golbeck et al.
4,701,581 A * 10/1987 Wodnicki et al. ..... 200/52 R
5,055,642 A 10/1991 Miyata

FOREIGN PATENT DOCUMENTS

| | | |
|---|---|---|
| DE | 24 03 983 | 8/1975 |
| DE | 33 05 556 | 9/1984 |
| DE | 32 17 138 | 1/1985 |
| FR | 2 307 453 | 12/1976 |
| GB | 1 549 900 | 8/1979 |

* cited by examiner

*Primary Examiner*—P. Austin Bradley
*Assistant Examiner*—Lisa N. Klaus
(74) *Attorney, Agent, or Firm*—Burns, Doane, Swecker & Mathis, LLP

(57) ABSTRACT

A key switch unit of synthetic material includes a housing and at least one key top connected to a spring section. The housing, key top and spring section are injection molded of one piece. The key top is folded back, whereby the spring section and the key top are disposed opposite one another. The key top and the spring section are elastically movable relative to the housing. By elastically pushing the key top against the spring section, the spring section is elastically displaced toward a switch element.

15 Claims, 2 Drawing Sheets

PUSHBUTTON UNIT

BACKGROUND OF THE INVENTION

The invention relates to a key switch unit made of synthetic material comprising a key switch housing and at least one key top with a corresponding spring section.

Such key switch units are used, for example, as control elements in front panels of household appliances such as wash machines or dishwashers and the like. The key switch unit is typically placed between a panel and a circuit board with electronic components in such a manner that the key top is located in an opening of the panel whereby down-ward force exerted on the key top is transferred via the spring section onto a switch, which is mounted on the circuit board. The spring section has the function to limit the force transferred to the switch whereby the small switch and the circuit board are not damaged even during forceful manual actuation of the key top.

Since the key top and the spring section are positioned on top of one another and since they mostly consist of different materials, they are currently manufactured as two separate components. Typically, several keys are positioned next to one another within the key switch unit. The spring sections, which are positioned parallel to one another, are connected to a so-called spring rack, whereas the key tops and the key switch housing are separate components, which have to be attached manually to the spring rack.

OBJECT AND SUMMARY OF THE INVENTION

It is the object of the invention to reduce assembly steps during manufacturing of the key switch unit.

This object is achieved according to the invention in that the key switch housing, the key top and the spring section are made in one piece wherein the key top is connected with the spring section by a strip hinge and whereby the key top can be folded back against the spring section.

The entire key switch unit may thereby be injection-molded in one piece with synthetic material, whereby the workpiece is designed in such a manner that the spring section and the key top are connected with a strip hinge in a straight position, so that both parts are essentially positioned at one plane whereby they may be easily deformed. During assembly, the key top is folded back against the spring section so that the spring section can be actuated by the key top. The complete key switch unit may then be mounted in this condition to the panel as a single component. Thereby no additional work steps are necessary for positioning and assembly of key tops and spring sections.

By using a multi-component, injection-molding process it is possible to manufacture the key tops and spring sections out of different materials even in the one-piece construction method so that the key top has a great mechanical stability. The key top may consist of a relatively hard and easy-to-clean substance whereas a more resilient material may be used for the spring section.

The key top may also be constructed in two layers. Thereby it is made possible to give the key top a two-color marking wherein a different-colored material is used in the lower layer of the key top and whereby an opening is created in the upper layer, which allows viewing of the lower layer or whereby the opening is filled with the material used in the lower layer.

Oftentimes the key tops have an indicator light, which is mounted on the circuit board and whereby its light is transmitted through a window or an optical light conductor to the front of the panel. According to further development of the invention, this window or the optical light conductor may also be manufactured in one piece together with the remaining elements of the key switch unit. A second or third material component consisting of a transparent or translucent synthetic material is used to make the window or the optical light conductor, respectively.

In some versions there is also a high-tension component located on the circuit board in addition to the low-voltage component, which includes relatively heavy components such as transformers and the like. In this case it is necessary for stability purposes to mount the circuit board in a circuit board housing made of synthetic material. In a special embodiment of the invention, this circuit board housing may also be manufactured in one piece together with the remaining elements of the key switch unit whereby this circuit board housing may be connected to the key switch housing with an additional strip hinge so that it may be folded back.

BRIEF DESCRIPTION OF THE DRAWINGS

Preferred embodiment examples of the invention are described in more detail below with reference to the drawings.

DETAILED DESCRIPTION OF PREFERRED EMBODIMENTS OF THE INVENTION

A first embodiment of the invention is illustrated in FIG. 1 through FIG. 4.

Figure 1:
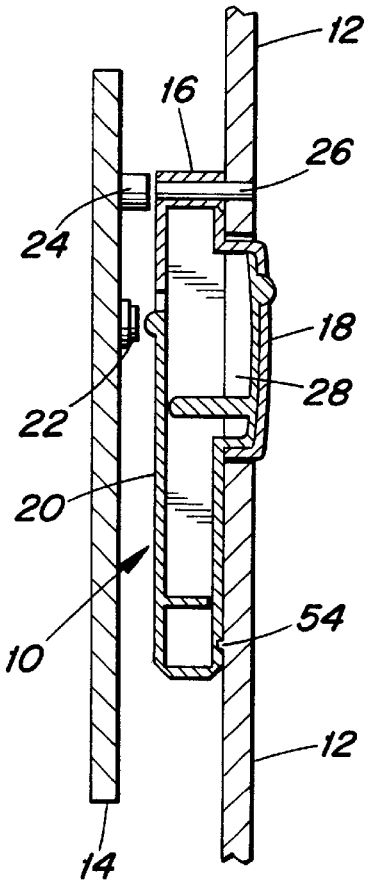
FIG. 1 shows a cross-sectional view through a front panel of a household appliance, a circuit panel located behind the front panel, and a key switch unit located between the front panel and the circuit board.

According to FIG. 1, a key switch unit 10 is mounted between a panel 12 of a household appliance and a circuit board 14 that is located parallel to said panel 12.

Figure 2:
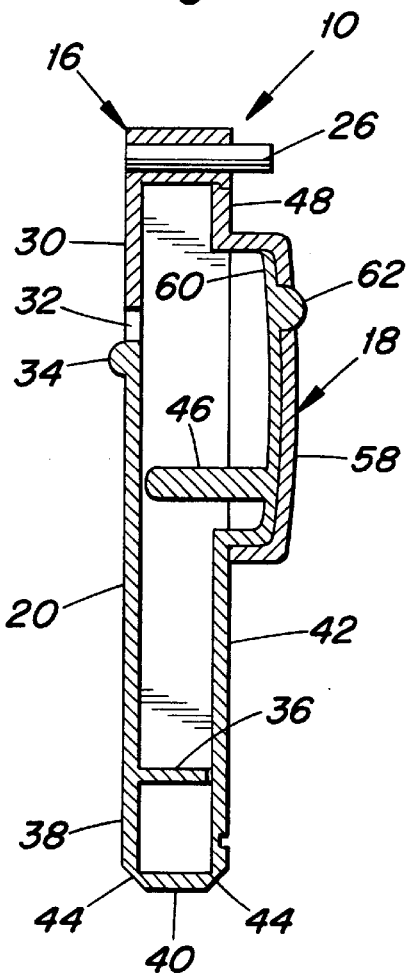
FIG. 2 shows a cross-sectional view through a key switch unit according to FIG. I in the assembled position and at an enlarged scale.
Figure 3:
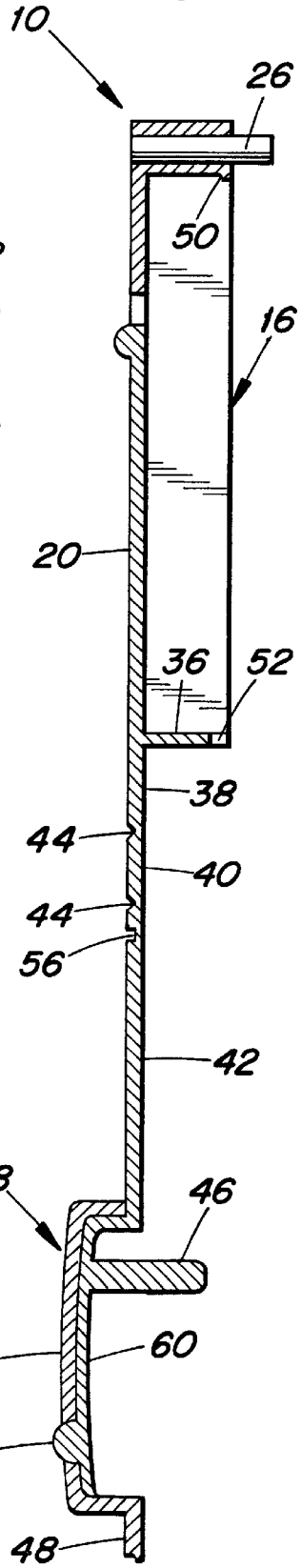
FIG. 3 shows a cross-sectional view through a key switch unit in its original state.

The key switch unit 10 is manufactured in one piece out of synthetic material and has a key switch housing 16 in the shape of a flat, box-shaped enclosure as well as a plurality of key tops 18, which each have a spring section 20. In FIG. 1 through FIG. 3 there can be seen only one of the key tops 18 and the corresponding spring section 20.

The circuit board 14 contains a plurality of electronic components. In the drawing there is shown only one switch 22 thereof and a corresponding indicator light 24. The key top 18 and the spring section 20 are designed and located in such a manner that the switch 22 may be actuated by the key top 18 via the spring section 20. The indicator light 24 has a light conductor 26 made of translucent material, for example polymethylmethacrylate (PMMA), which is injection-molded as one piece into the upper side of the key switch housing 16 and which fits tightly with its free end section into the opening of panel 12 provided for this purpose, so that the light emitted by the indicator light 24 is transmitted to the front of the panel 12.

The key top 18 is a bridge-shaped element, which fits tightly into the opening 28 in the panel 12 and which is slightly raised relative to the front of said panel 12.

The box-shaped key switch housing 16 is fastened to the panel 12 in a well-known manner with snap-in locking means, which are not shown.

Figure 4:
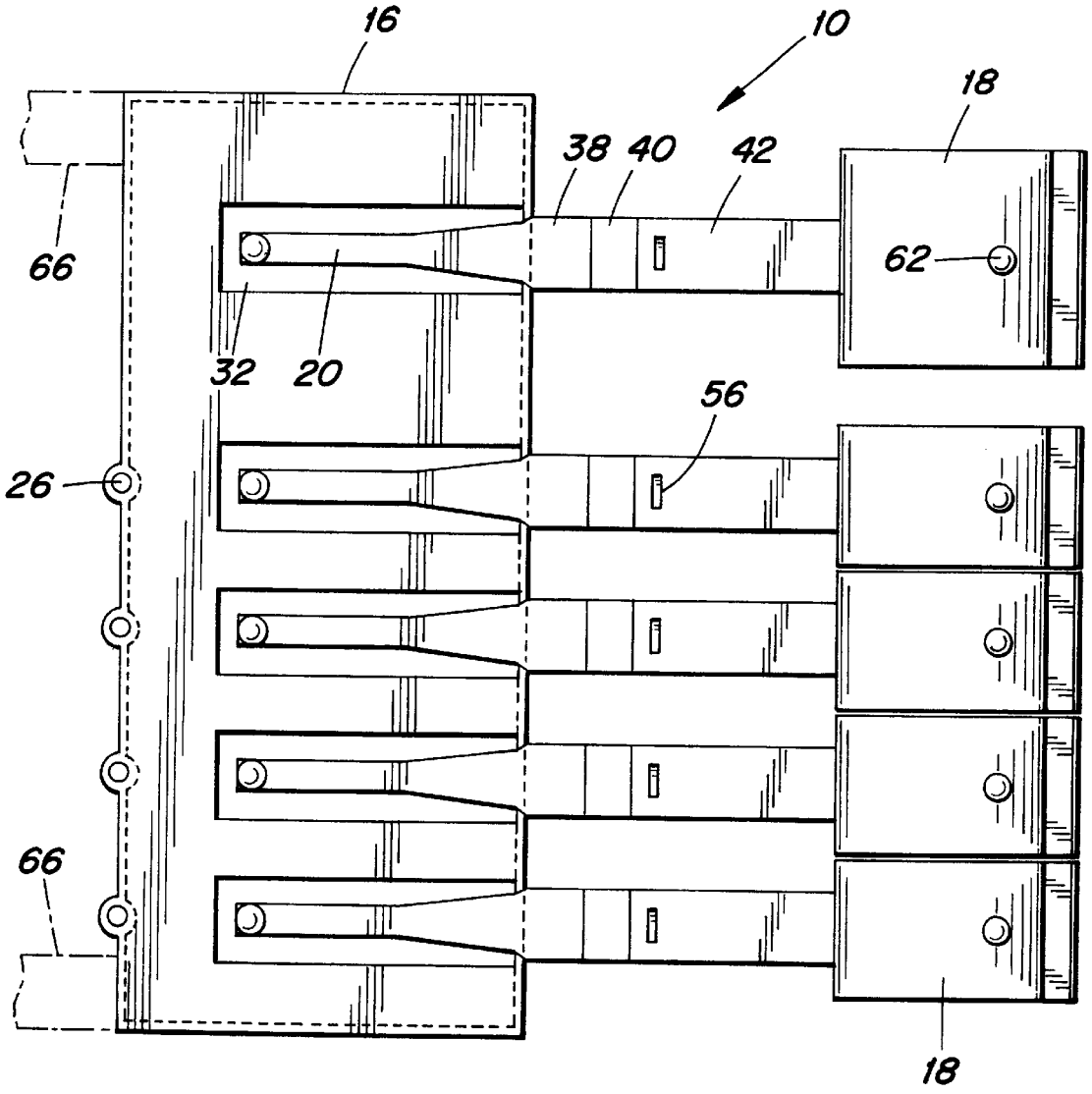
FIG. 4 shows the key switch unit in a view from the left in relation to FIG. 3.

As it can be clearly seen in FIG. 2 through FIG. 4, the spring section 20 is a flat elastic tongue, which is bonded to the housing bottom 30 of the key switch housing 16 and which is separated at three sides from said housing bottom by an open space 32. The spring section 20 has at its end a nipple 34 to actuate the switch 22.

The spring section 20 extends at the lower end past the housing wall 36 of said key switch housing and continues along three fixed links 38, 40, 42, which are connected as one piece by strip hinges 44 and which are angled at a right angle at said spring hinges 44 in their assembled position according to FIG. 2.

The fixed link 42, which runs parallel to the spring section 20 with a space in between, covers said key switch housing 16 in form of a lid and has the key top 18 attached to its free end.

When said key top 18 is pushed down with a finger (to the left in FIG. 2), then the link 42 is elastically bent so that a plunger 46 on the key top pushes on the spring section 20 and causes said spring section to be also elastically deformed. The nipple 34 comes thereby into contact with switch 22 and actuates the switch. Even if the key top 18 is pushed down with force, the elastic bending of the spring section 20 causes the force exerted onto the switch 22 to be limited.

Since the link 42 rests against the housing wall 36 of the key switch housing, the key top 18 returns resiliently in a spring-like motion back into its original position as soon as it is released.

FIG. 3 and FIG. 4 show the key switch unit 10 in the condition in which it was taken out of the injection mold. In this state, the strip hinges 44 are in a straight line and the links 38, 40 and 42 are coplanar with the spring section 20. In order to deform the key switch unit into the assembled position, according to FIG. 2, the key top 18 is folded back at a strip hinge 44 toward the spring section 20. A snap-in nose 48, located at the free end of the key top 18, snaps thereby into a catch 50 at the upper side of the key switch housing 16 and thereby retains the key top in its assembled position. The link 42 rests against a shallow recess 52 at the housing wall 36 of said key switch housing so that the key top is positioned against movement in a transverse direction relative to the spring section 20, which means in the direction perpendicular to the plane of the drawing in FIG. 3, which is the correct position relative to the spring section 20.

When said key switch unit is then attached to the panel 12, a rib 54 (FIG. 1) molded to said panel engages into a groove 56 formed in the link 42 and causes hereby positioning of the key top 18 in its longitudinal direction, which means in a vertical direction in FIG. 2. The key top 18 is then correctly positioned in this manner in relation to the opening 28 of the panel 12. This positioning may be accomplished, of course, by any other type of a form-fitting connection between the panel 12 and the link 42, for example by using a slit instead of the groove 56 or by using a rib on the link 42 and a groove or slit on the panel.

The key switch unit 10 is injection-molded in a three-component process and consists therefore of three different materials. The key top 18 has a two-layer structure with an outer layer 58 and an inner layer 60. The outer layer 58 as well as the key switch housing 16, with the exception of the housing wall 36, consists of a relatively rigid material, for example ABS resin, which allows easy shaping of the key switch housing and which gives the outer surface of the key top 18 a relatively hard, smooth and easy-to-clean surface as well. The lower layer 60 of the key top 18, the spring section 20, the links 38, 40 and 42 and the housing wall 36 of the key switch housing consist in contrast of a resilient material, for example polyoxymethylene (POM). The third material component forms the light conductor 26.

The upper layer 58 of the key top 18 has an opening which is filled with a bead 62 of the material used in the lower layer 60. When the POM has a different color as the ABS resin, then a different-colored marking 62 may be produced on the key top 18.

Figure 5:
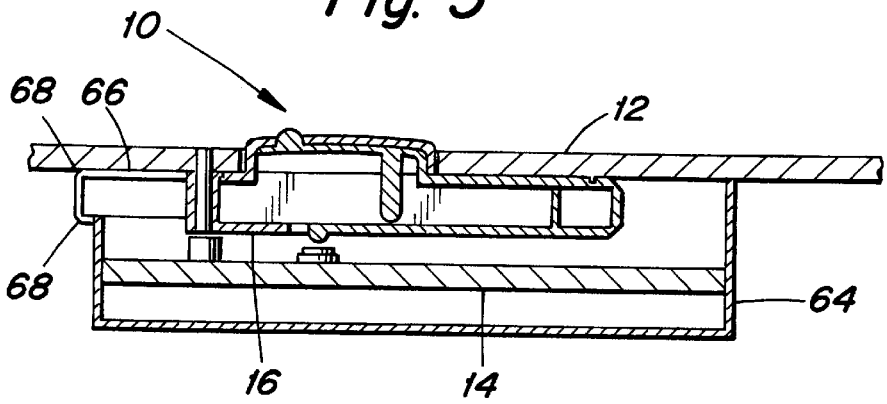
FIG. 5 shows a cross-sectional view through a key switch unit according to another embodiment example.

FIG. 5 shows a variant embodiment of the key switch unit 10 of the invention, which has additionally a one-piece, cast-on circuit board housing 64 in the shape of a flat disk, which is open on top and which is connected with the key switch housing 16 by two links 66 and whereby said links have each two strip hinges 68. The links 66, which are also indicated in FIG. 4 by a dotted line, are connected to the side of the key switch housing 16 that is opposite the key tops 18.

During manufacturing of the key switch housing as one injection-molded part, the strip hinge 66 is in a straight position similar to the strip hinges 40 whereby the circuit board housing 64 is positioned at the same plane as the key switch housing 16 and the key tops 18. The box-shaped key switch housing 16 and the circuit board housing 64 are open at opposite sides so that they both may be easily deformed.

The invention may be developed further in that the entire key switch unit, with or without a circuit board housing, may be connected to a panel 12 by an additional strip hinge, for example, and therefore being in one piece.

What is claimed is:

1. A key switch unit made of synthetic material, comprising a key switch housing and at least one key top with a corresponding spring section, wherein the key switch housing, the key top and the spring section are made in one piece and wherein the key top is connected to the spring section by a strip hinge, whereby said key top is foldable back onto said spring section, wherein said key top forms a front external wall of the said switch unit, and said spring section forms an oppositely disposed rear external wall of said switch unit, said key top arranged to be manually elastically flexed in a rearward direction into engagement with said spring section, said spring section being elastically flexible in said rearward direction in response to being pushed by said key top.

2. The key switch unit according to claim 1, wherein said key switch unit is injection molded of at least two different materials.

3. The key switch unit according to claim 2, wherein said key switch unit is made in one piece together with a window or a light conductor made of translucent or transparent material.

4. The key switch unit according to claim 3, wherein at least some parts of the key switch housing and the key top are made of a different material than the spring section.

5. The key switch unit according to claim 4, wherein the key top has an outer layer and an inner layer made of different-color materials and wherein a colored marking is created in an opening in the outer layer of said key top, said opening allowing an open view onto the material of the inner layer.

6. A key switch unit according to claim 5, wherein the key switch housing has the shape of a flat box and wherein the spring section is located in a cut-out of a housing bottom of the key switch housing, said spring section extending past the key switch housing by means of links which have strip hinges attached at a distance that is equal to a height of the box-shaped key switch housing, and wherein the outer link supports the key top at its free end, wherein the spring section, the links, and the inner layer of the key top are formed of the same material.

7. The key switch unit according to claim 4, wherein the key top has an outer layer and an inner layer made of different color materials, and wherein a colored marking is created in an opening in the outer layer, the opening being filled with a portion of the inner layer.

8. The key switch unit according to claim 7 wherein the key switch housing has the shape of a flat box and wherein the spring section is located in a cutout of a housing bottom of the key switch housing, said spring section extending past the key switch housing by means of links which have strip hinges attached at a distance that is equal to a height of the box-shaped key switch housing, and wherein the outer link supports the key top at its free end, wherein the spring section, the links, and the inner layer of the key top are formed of the same material.

9. A switching apparatus comprising:

a circuit board carrying a switch element, and a key switch unit positioned adjacent the circuit board, the key switch unit formed of synthetic material and comprising a housing and at least one key top with a corresponding spring section, wherein the key switch housing, the key top and the spring section are made in one piece, and wherein the key top is connected to the spring section by a strip hinge, said key top being folded about the strip hinge whereby the key top is disposed opposite to the spring section, the key top being elastically displaceable relative to the housing toward the spring section to engage and displace the spring section elastically relative to the housing and into pushing relationship with the switch element.

10. A key switch unit made of synthetic material, comprising a key switch housing and at least one key top with a corresponding spring section, wherein the key switch housing, the key top and the spring section are made in one piece and wherein the key top is connected to the spring section by a strip hinge, whereby said key top is foldable back onto said spring section, wherein said key switch unit is injection molded of at least two different materials.

11. A key switch unit made of synthetic material, comprising a key switch housing and at least one key top with a corresponding spring section, wherein the key switch housing, the key top and the spring section are made in one piece and wherein the key top is connected to the spring section by a strip hinge, whereby said key top can be folded back onto said spring section, wherein the key switch housing has the shape of a flat box and wherein the spring section is located in a cut-out of a housing bottom of the key switch housing, said spring section extending past the key switch housing by means of links, which have strip hinges attached at a distance that is equal to a height of the box-shaped key switch housing, and wherein an outermost one of the links supports the key top at a free end of the outer link.

12. The key switch unit according to claim 11, wherein an end piece of the key top, which is located on the opposite side of the links, is snappable into the key switch housing when the key top is folded back.

13. The key switch unit according to claim 11, wherein the key top is raised relative to a plane of an adjoining one of the links and wherein said adjoining link has a transversely running groove disposed in the same side of the link that the key top is raised from, the groove adapted to receive a rib formed on a panel in which the key switch is to be mounted.

14. A key switch unit made of synthetic material, comprising a key switch housing and at least one key top with a corresponding spring section, wherein the key switch housing, the key top and the spring section are made in one piece and wherein the key top is connected to the spring section by a strip hinge, whereby said key top is foldable back onto said spring section, the key switch unit further comprising a one-piece cast-on circuit board housing, which is foldably connected to the key switch housing.

15. A key switch unit made of synthetic material, comprising a key switch housing and at least one key top with a corresponding spring section, wherein the key switch housing, the key top and the spring section are made in one piece and wherein the key top is connected to the spring section by a strip hinge, whereby said key top is foldable back onto said spring section, the key switch unit further comprising a panel integrally connected to the key switch unit by a foldable connection enabling the panel to be folded relative to the key switch unit.

* * * * *